US009682329B1

(12) United States Patent
Goitein

(10) Patent No.: US 9,682,329 B1
(45) **Date of Patent: *Jun. 20, 2017**

(54) ELECTRIC POWER PAPER AIRPLANE CONVERSION KIT/UNIT

(71) Applicant: Shai Goitein, Pardes Hana (IL)

(72) Inventor: Shai Goitein, Pardes Hana (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/186,711

(22) Filed: Jun. 20, 2016

Related U.S. Application Data

(63) Continuation of application No. 13/848,151, filed on Mar. 21, 2013, now Pat. No. 9,375,650.

(60) Provisional application No. 61/614,390, filed on Mar. 22, 2012.

(51) Int. Cl.
*A63H 27/00* (2006.01)
*A63H 29/22* (2006.01)
*A63H 33/16* (2006.01)

(52) U.S. Cl.
CPC ..... *A63H 29/22* (2013.01); *A63H 27/001* (2013.01); *A63H 33/16* (2013.01)

(58) Field of Classification Search
CPC .... A63H 27/02; A63H 27/001; A63H 27/007; A63H 27/06; A63H 29/22; A63H 33/16; B64C 2201/146
See application file for complete search history.

(56) References Cited

U.S. PATENT DOCUMENTS

| | | | | |
|---|---|---|---|---|
| 1,035,017 | A | 8/1912 | Kaiser et al. | 446/60 |
| 2,715,445 | A | 8/1955 | Williamson | 416/20 R |
| D214,803 | S | 7/1969 | Limb | D21/449 |
| 3,699,708 | A | 10/1972 | Mabuchi | 446/57 |
| 3,714,743 | A | 2/1973 | Livingston | |
| 3,757,462 | A | 9/1973 | Mabuchi | 446/58 |
| D241,564 | S | 9/1976 | Kabchef | D21/449 |
| 3,985,322 | A | 10/1976 | Mabuchi et al. | 248/554 |
| D245,637 | S | 8/1977 | Jewett | D21/450 |
| 4,180,221 | A | 12/1979 | Harris | 244/13 |
| 4,377,051 | A | 3/1983 | Dulake | 446/31 |
| 4,530,477 | A | 7/1985 | Ito et al. | 244/153 R |
| 5,525,087 | A | 6/1996 | Chin-Lin | 446/59 |
| 6,520,823 | B2 | 2/2003 | Tian et al. | 446/57 |
| 6,568,980 | B2 | 5/2003 | Barthold | 446/36 |
| 6,688,937 | B1 | 2/2004 | Tsai | 446/67 |
| 6,969,920 | B1 | 11/2005 | Severinghaus | |
| 7,331,838 | B2 | 2/2008 | Shantz | 446/57 |

(Continued)

FOREIGN PATENT DOCUMENTS

| | | |
|---|---|---|
| JP | 11150036 A | 6/1999 |

*Primary Examiner* — Melba Bumgarner
*Assistant Examiner* — Amir Klayman
(74) *Attorney, Agent, or Firm* — Robert W. J. Usher

(57) ABSTRACT

A toy paper airplane conversion kit has a nose-piece with a combination capacitor mounting portion and nose clip connected to a rear, electric motor driven propellor unit by a lead receiving, square section conductor conduit which keys into a complementary socket of the motor mount, maintaining the rear propellor unit tilted upward. The nose-piece has a combination capacitor mount and nose clip with two paper-clamping, cantilever spring arms extending rearwardly in spaced-apart, coplanar, side-by-side relation under the capacitor mounting portion and having converging portions adjacent rear free ends and, a stubby, paper spreading, crease stuffing fin from the nose-piece, rearward of free ends of the springs. The capacitor mouth receiving a charging plug of a battery pack unit.

6 Claims, 13 Drawing Sheets

(56) References Cited

U.S. PATENT DOCUMENTS

| | | | | |
|---|---|---|---|---|
| 7,377,832 | B2 | 5/2008 | Chamberlain | 446/57 |
| 2003/0197092 | A1 | 10/2003 | Tian et al. | 244/51 |
| 2005/0233672 | A1 | 10/2005 | Shantz | 446/232 |
| 2008/0125002 | A1 | 5/2008 | Goitein | 446/57 |
| 2009/0017714 | A1 | 1/2009 | DeRennaux et al. | 446/93 |
| 2009/0229921 | A1 | 9/2009 | Sink et al. | 185/39 |
| 2011/0262789 | A1 | 10/2011 | Tu | 429/100 |

Fig. 10a
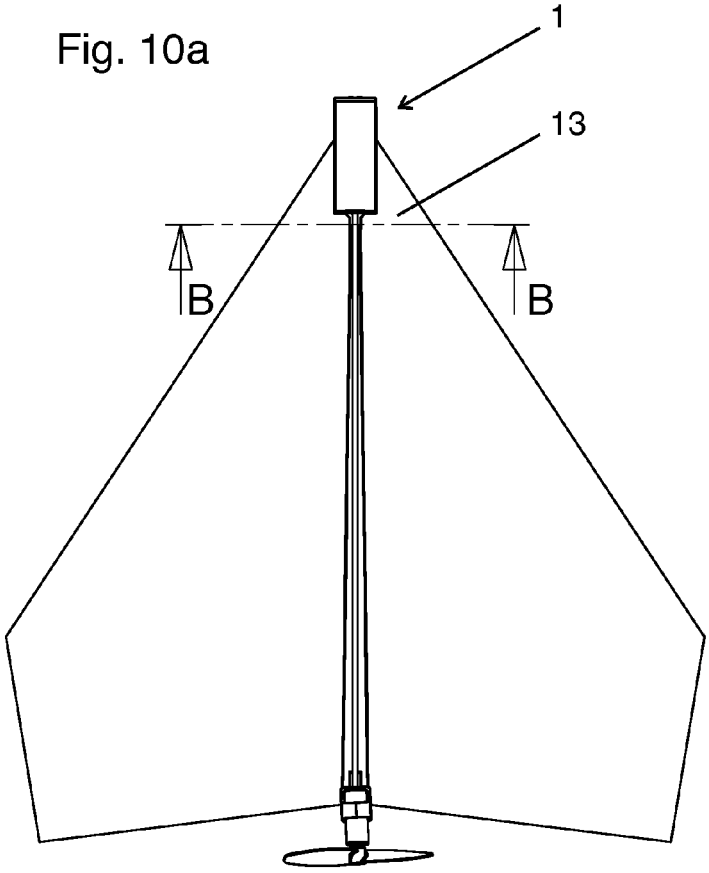
Fig. 10b
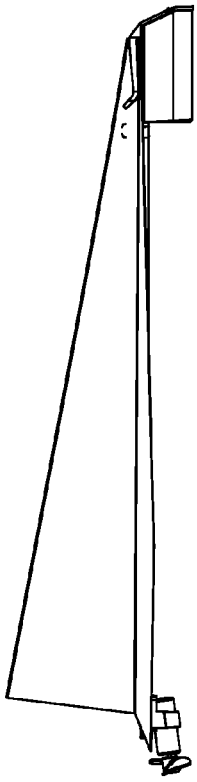
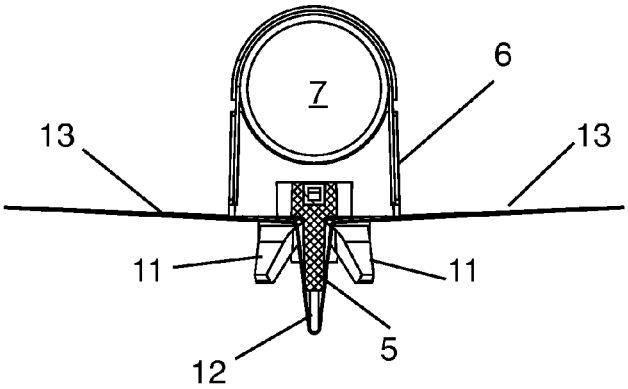
Fig. 10c

Prior art Fig. 11
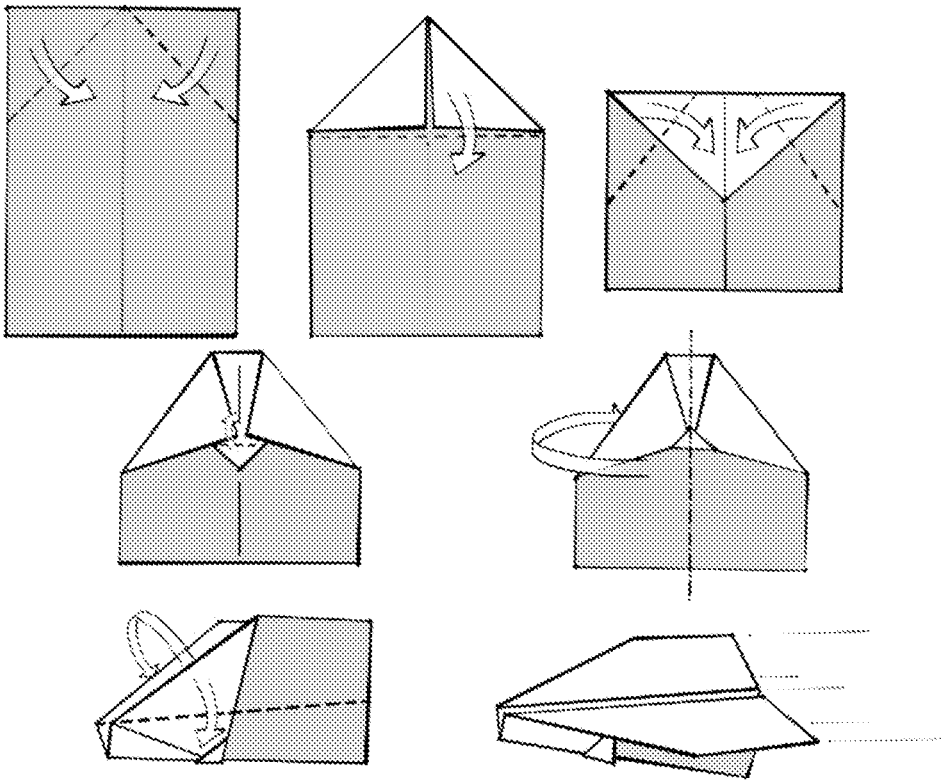

ELECTRIC POWER PAPER AIRPLANE CONVERSION KIT/UNIT

RELATED APPLICATIONS

This is a continuation of application Ser. No. 13/848,151 filed Mar. 21, 2013, the disclosure of which is incorporated by reference.

Priority is claimed from my provisional application 61/614,390 filed Mar. 22, 2012, the disclosure of which is incorporated herein by reference. The disclosure of my design patent application Ser. No. 29/416,487 also filed Mar. 22, 2012, is also incorporated herein by reference.

FIELD OF THE INVENTION

The invention relates to an electric power, paper airplane, conversion kit and conversion unit.

BACKGROUND OF THE INVENTION

A common paper glider/sailplane, folded from standard A4 or letter paper by following the steps shown in FIG. 11 and known as the Eagle design or Nakamuru lock design, can glide for a few seconds following hand launching into the air.

The invention concerns an electrical power conversion kit/unit which can be mounted on such common airplane design to provide adequate propulsion to transform the paper sailplane into a free flight, soaring paper airplane.

A prior electric power conversion unit, disclosed in my prior patent publication 2008/0125002, published May 29, 2008, and comprising a battery housing nose-piece connected by a wire receiving conduit to a rear electric motor driving a propellor is secured to the leading edges of the paper aiplane wings on each side of a central (fuselage) crease by a nose-piece clip portion. The clip portion has a pair of leaf springs extending rearwardly in spaced-apart, coplanar, side-by-side relation below the battery holding housing portion. A vertical fold/paper (fuselage) crease is received between the leaf springs which exert a vertical clamping force on leading edge portions of the horizontal wings on each side of the crease.

A disadvantage of my prior approach is that the clip exerts only a vertical clamping force on the paper wings which can be insufficient for reliable retention during powered flight and does not reliably prevent yaw of the power unit relative to the paper plane when under power, as torque is applied to the power unit as a result of the rotation of the propellor.

SUMMARY OF THE INVENTION

It is an object of the invention to provide a power unit which reliably mounts to a paper airplane throughout powered flight without significant yaw and to improve the power to weight relation by obviating the requirement for a relatively heavy battery to be the power source.

According to one aspect of the invention, a toy airplane comprises paper wings extending horizontally from respective opposite longitudinal free edges of a vertical, fuselage forming crease and an electric power conversion unit operably mounted thereon, the electric power conversion unit comprising:

a nose piece molded in one piece of plastic and comprising a combination capacitor mounting portion and nose clip;

a rear propulsion unit including an electric motor mount and motor driving a pusher propellor and, an electrical lead connecting the capacitor to the electric motor and contained in a conduit extending rearwardly (above the crease) to the tail; wherein:

the conduit is of square cross-section and keys into a complementary socket of the motor mount maintaining the rear propulsion unit tilted upward at a predetermined angle relative to the nose-piece as required for flight stability; and, the nose clip comprising a pair of cantilever spring arms extending rearwardly in spaced-apart, coplanar, side-by-side relation under the capacitor mounting portion and having converging portions adjacent their rear free ends and, a stubby, paper spreading fin depending from the nose-piece rearward of free ends of the springs and stuffed into the vertical paper crease, maintaining the paper walls of the crease spread apart with the vertical paper crease received between the leaf springs and the converging portions of the spring arms in horizontal, inward clamping engagement with the vertical walls of the paper crease which are urged horizontally apart by the spreading action of the fin and with leading edge portions of the horizontal wings on each side of the crease clamped vertically between respective cantilever arms and the capacitor mounting portion.

The weight of the conversion kit in the center of the airplane will tend to raise the dihedral angle, (the wings), thus reducing lift properties. The crease spreading action of the fin will tend to reduce the dihedral angle, forcing the wing tip downward at least partly compensating for the weight effect of the conversion kit.

BRIEF DESCRIPTION OF THE DRAWINGS

In order that the invention may be readily understood, a specific embodiment thereof will now be described with reference to the accompanying drawings in which:

FIGS. 10*a*, 10*b* and 10*c* are, respectively, a top plan view of the airplane, a side elevation and a cross-sectional view taken along lines B-B of FIG. 10*a;*

FIG. 11 is a schematic showing sequentially the paper folding steps for forming a typical conventional paper airplane paper;

DESCRIPTION OF PARTICULAR EMBODIMENT

Figure 15A:
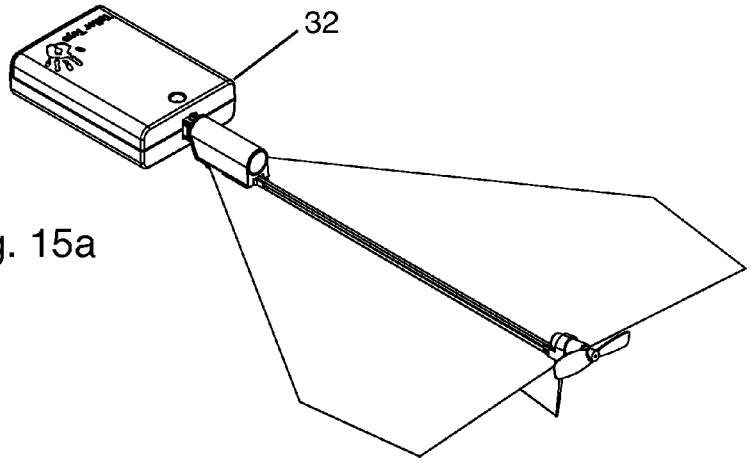
FIGS. 15*a*, 15*b* and 15*c* are a perspective view, a side elevation, and a plan view, partly sectioned along lines E-E of FIG. 15*b*, of a power conversion kit including a capacitor charging unit and a power unit.
Figure 15C:
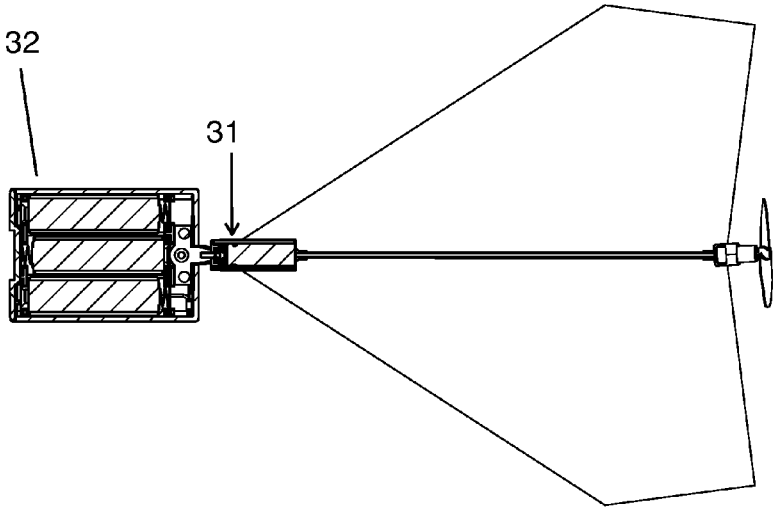
Figure 15B:
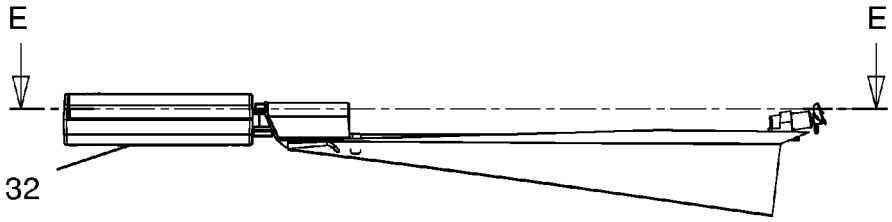

As shown particularly in FIGS. 1-9, the conversion kit/unit comprises a nose piece 1 formed by a molded, one-piece, plastic, frame member 2 providing a combined nose clip 3 and capacitor mounting portion 4. The nose clip 3 mounts universally to folded paper airplanes that have a fuselage formed by a V-shaped vertical crease 5, (FIG. 9), while the capacitor mounting portion 4 captures and, in cooperation with an adhered printed plastic foil hood 6, covers a quick charge, slow discharge super capacitor 7, (FIG. 3) that stores the energy transferred to it by a 4.5V electric charger, (FIGS. 15*a*-15*c*). The nose-clip is secured to a square section, tubular, carbon fiber, wire conduit 8 that is also secured in a complementary square socket 9 in a rear motor mount 10. This square tube 8 functions as a key, maintaining the combined nose clip and capacitor mount and the rear motor mount 10 in a predetermined alignment required to achieve the precise location and angle of the propulsion vectors with regard to the center of gravity of the paper airplane and airplane axis which will effect the pitch and yaw of the airplane during flight.

The propulsion unit is a rear pusher propeller which will, in operation, tend to demount the module from the paper airplane nose. In order to retain the nose-piece firmly and accurately in place, the nose-clip has three special friction gripping interfaces including a pair of rearwardly convergent leaf springs 11 in cooperation with a rearwardly adjacent, crease spreading fin 12.

The first is achieved by the cantilever arm springs pressing upwards so that the horizontally extending paper 13 is gripped between the springs 11 and opposed, spaced apart limbs 14 of a rectangular portion of the frame, together with the tube 8.

The second friction interface is on the sides of the vertical V-shape fuselage forming crease 5. The cantilever spring arms of the clip portion clamp vertical walls of the crease horizontally together (FIG. 5).

The third friction element is the crease spreading/stuffing fin 12, depending rearwardly of the frame member of the nose-piece, and positioned to protrude into the crease. The counter-reacting forces between the springs 11 and the outer surfaces of the paper forming the V-groove, the fin and the inner sides of the paper V-groove and bottom horizontal surface of the clip frame and the top surface above the V-groove, provide a strong gripping action creating the required fastening and accurate solution needed.

Figure 1A:
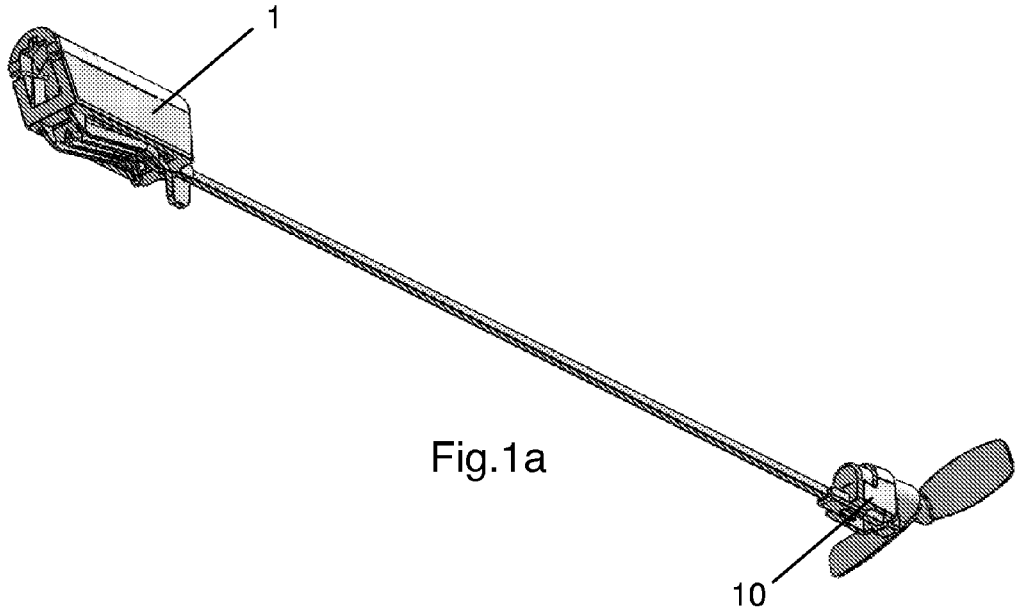
FIGS. 1*a* and 1*b* are perspective views of the power unit from below and above, respectively.
Figure 1B:
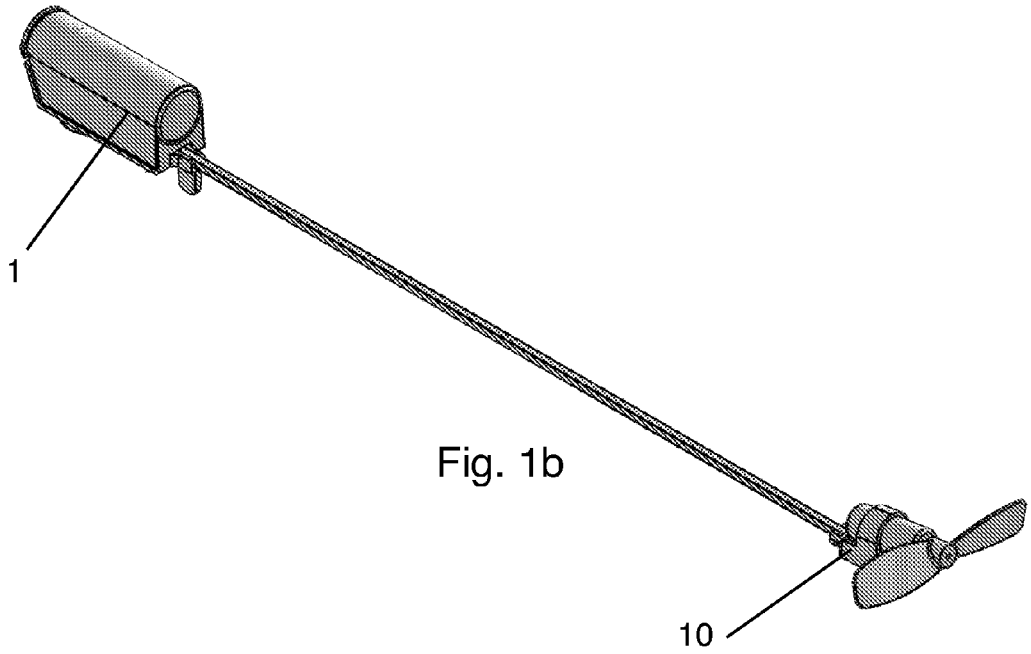
Figure 2:
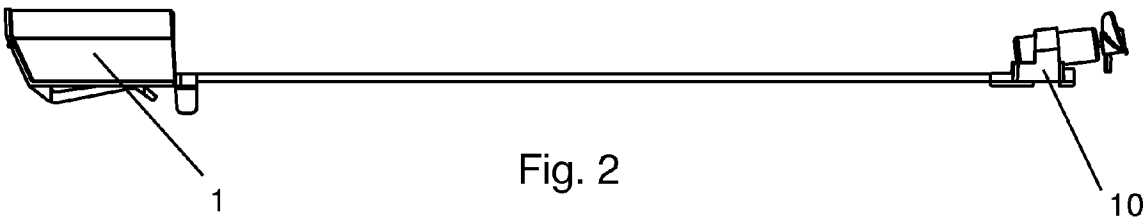
FIG. 2 is a side elevation of the power unit.
Figure 3:
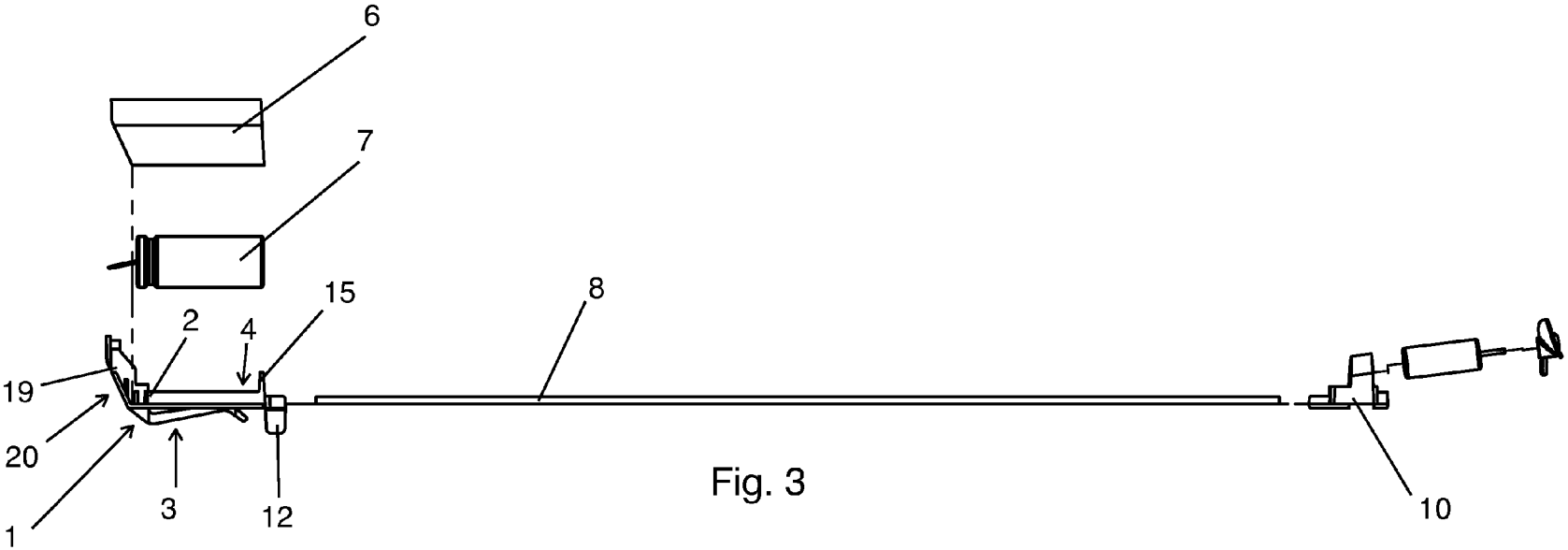
FIG. 3 is an exploded, fragmentary view of the power unit shown in FIG. 2.
Figure 4:
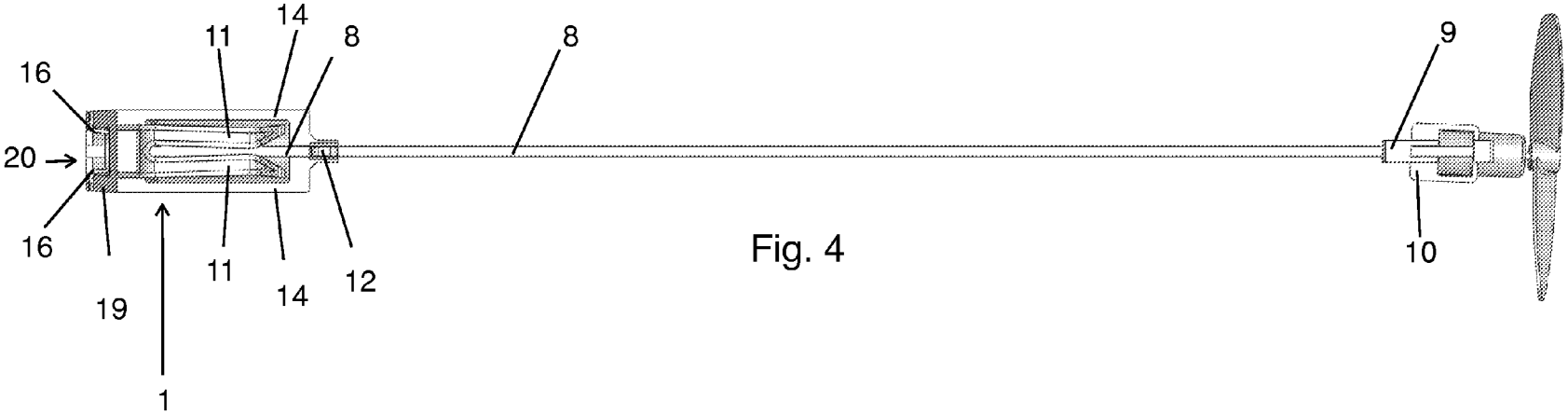
FIG. 4 is a view of the power unit from below.
Figure 5:
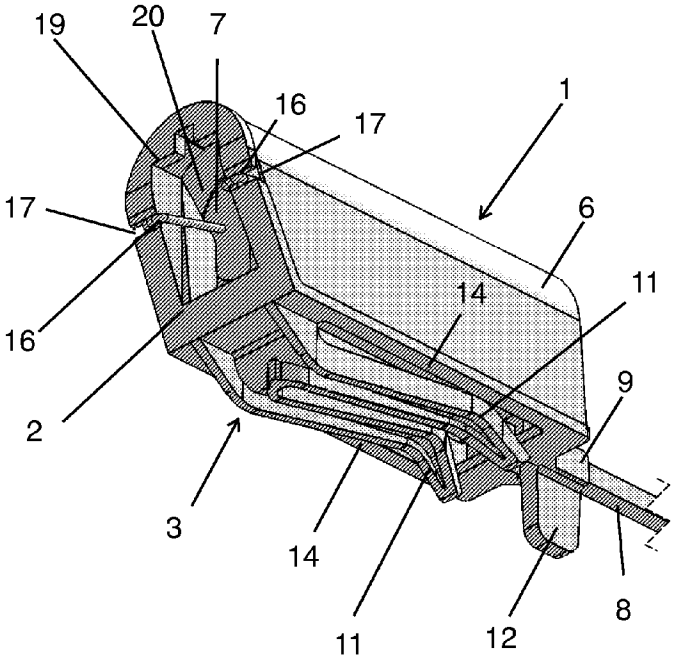
FIG. 5 is an enlarged perspective view of the nose-piece of the power unit shown in FIG. 1*a*
Figure 6:
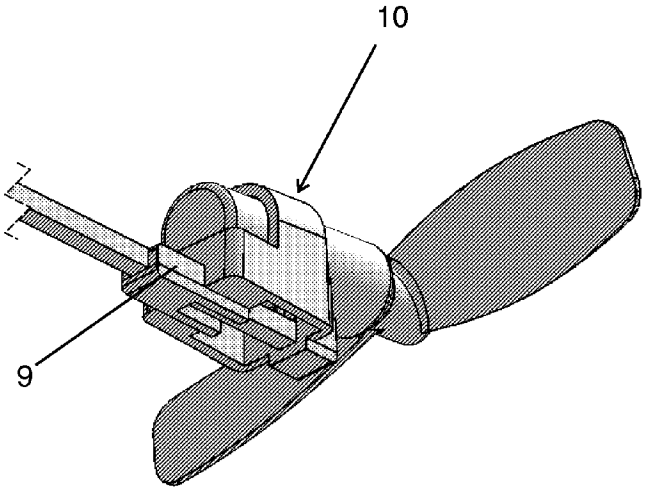
FIG. 6 is an enlarged perspective view of the rear propulsion unit of the power unit shown in FIG. 1*a;*
Figure 7:
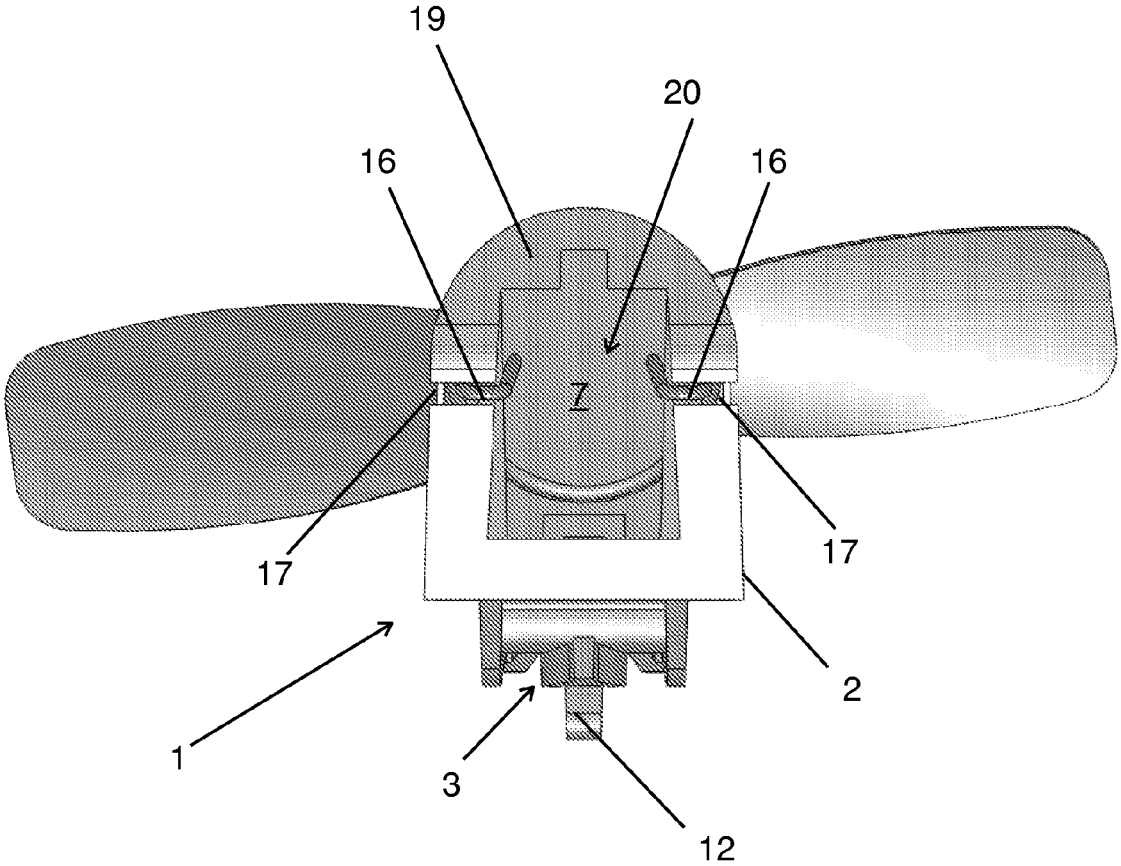
FIG. 7 is a enlarge front view of the power unit.
Figure 8:
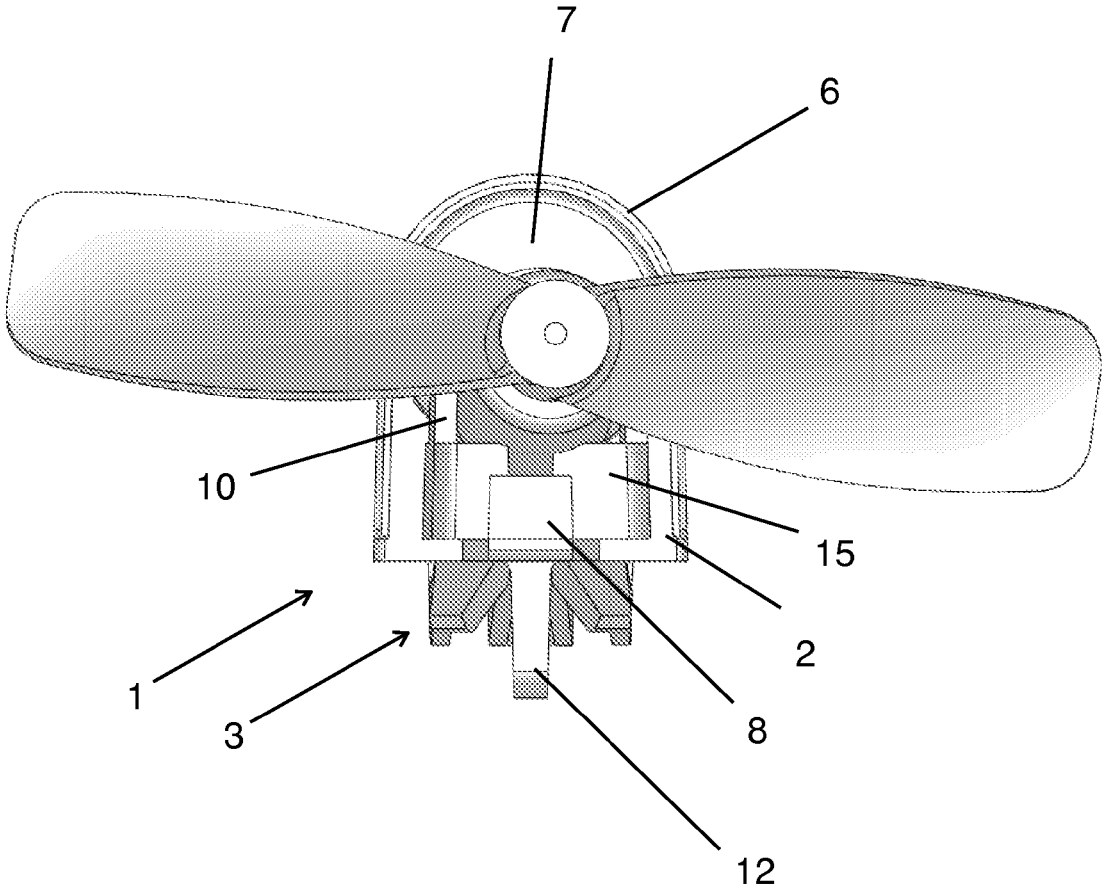
FIG. 8 is an enlarged rear view of the power unit
Figure 9:
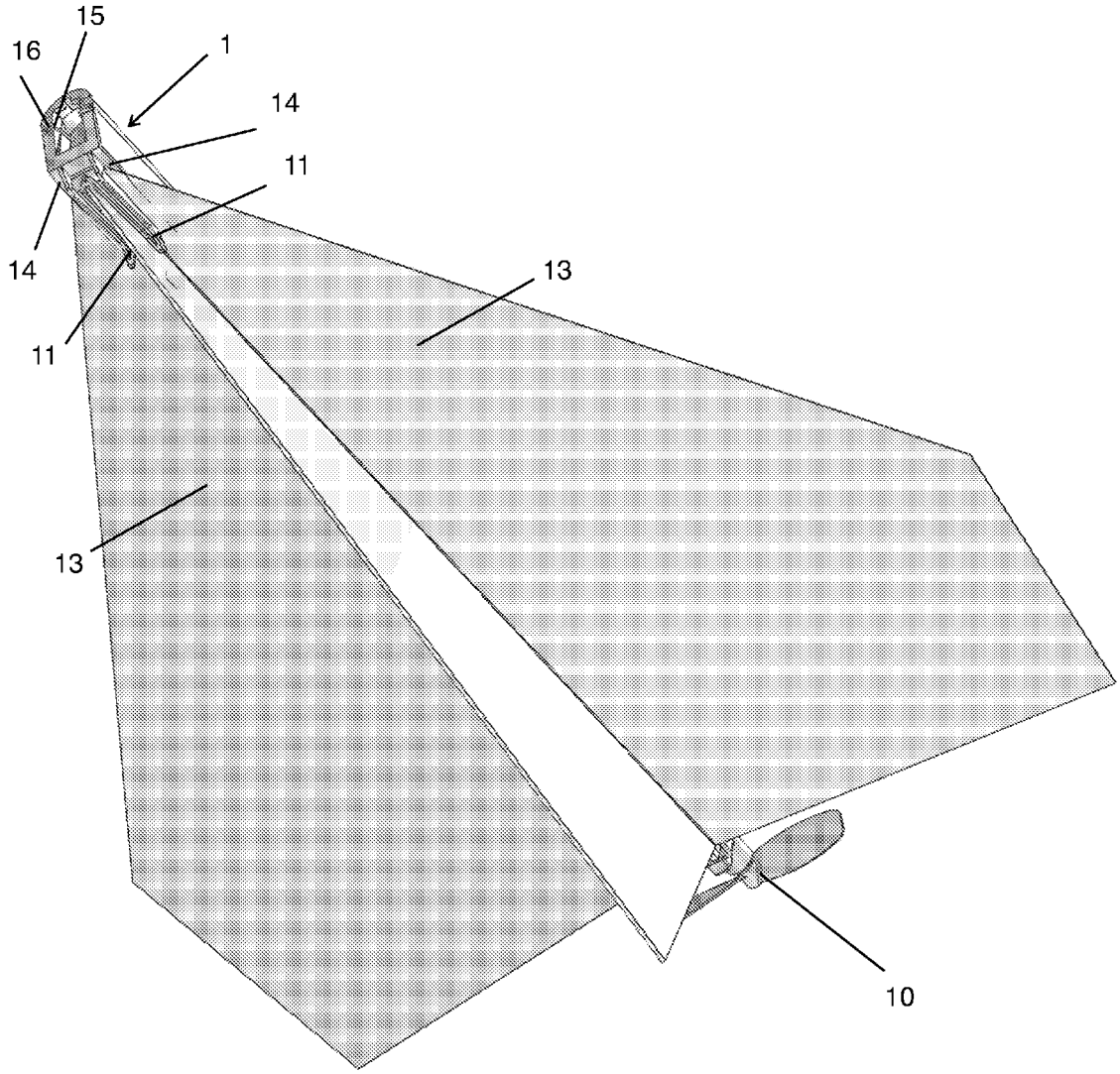
FIG. 9 is a perspective view of the underside of a paper airplane on which the power unit is mounted.
Figure 12:
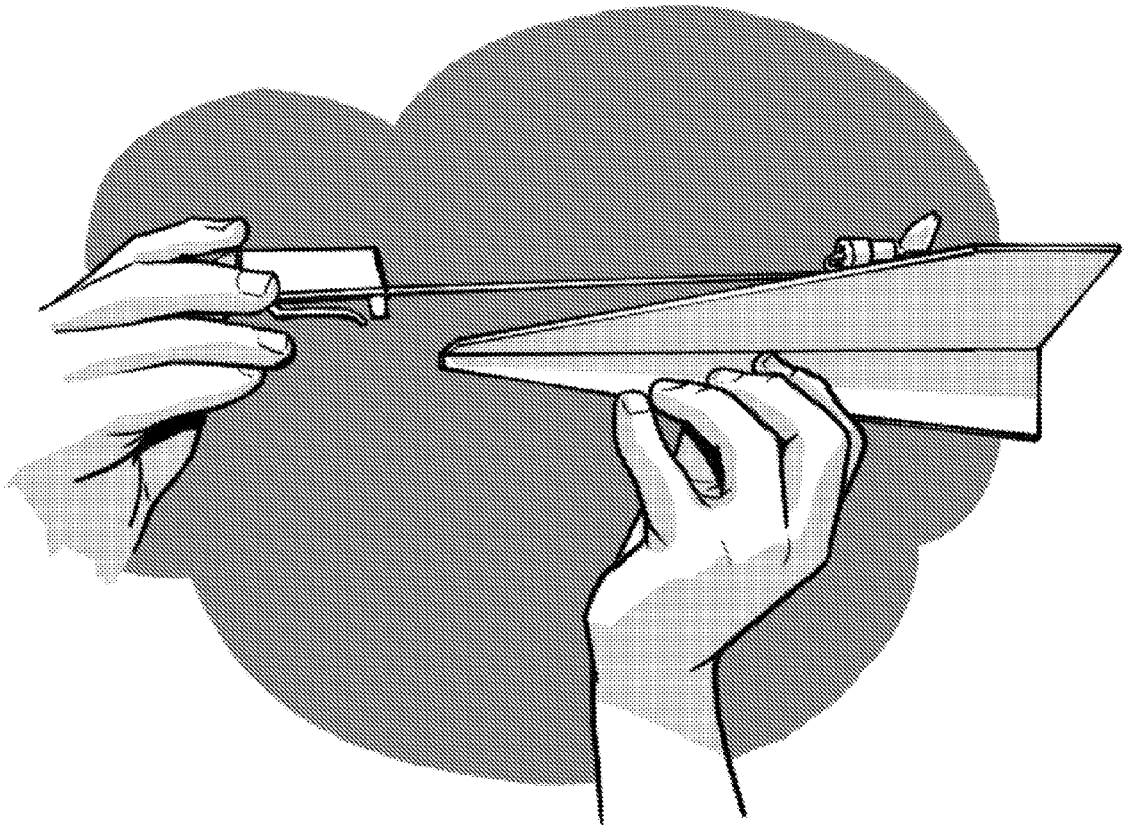
FIG. 12 is a perspective view showing a power unit being aligned with the formed paper airplane prior to mounting thereon.
Figure 13:
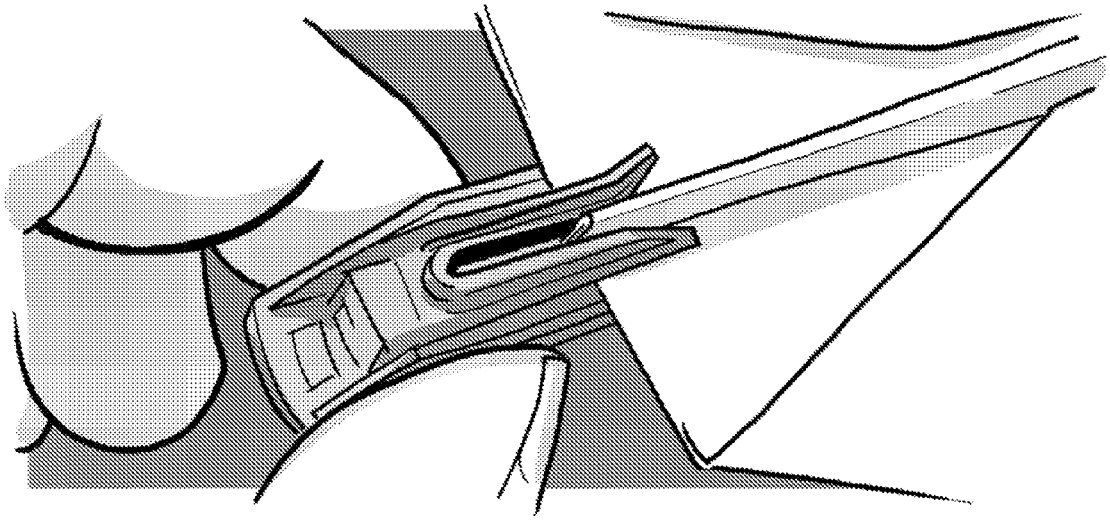
FIG. 13 is a fragmentary perspective view of the underside of the nose-piece being clipped onto the paper airplane.

The capacitor 7 is securely mounted to the nose-piece housing against an upstanding rear abutment portion 15, by reversely bending the capacitor leads 16 into front opening wire retaining grooves 17, preformed on opposite sides of outwardly extending lip flanges of an annular frame portion 19 and then bending the wires downward behind those flanges, as best seen in FIG. 5. The annular frame portion forms a mouth 20 of a front, charging receptacle for receiving a capacitor charging plug 31 when temporarily connecting a battery pack 32 to the respective leads to charge the capacitor 7, as shown in FIGS. 15*a*-15*c*. The quick charge, slow discharge, 2.7 volt, 10 Farad capacitor can be charged in approximately 20 seconds using the pack of 3×1.5 v AA batteries shown, to provide a powered flight time of approximately 30 seconds.

Figure 14:
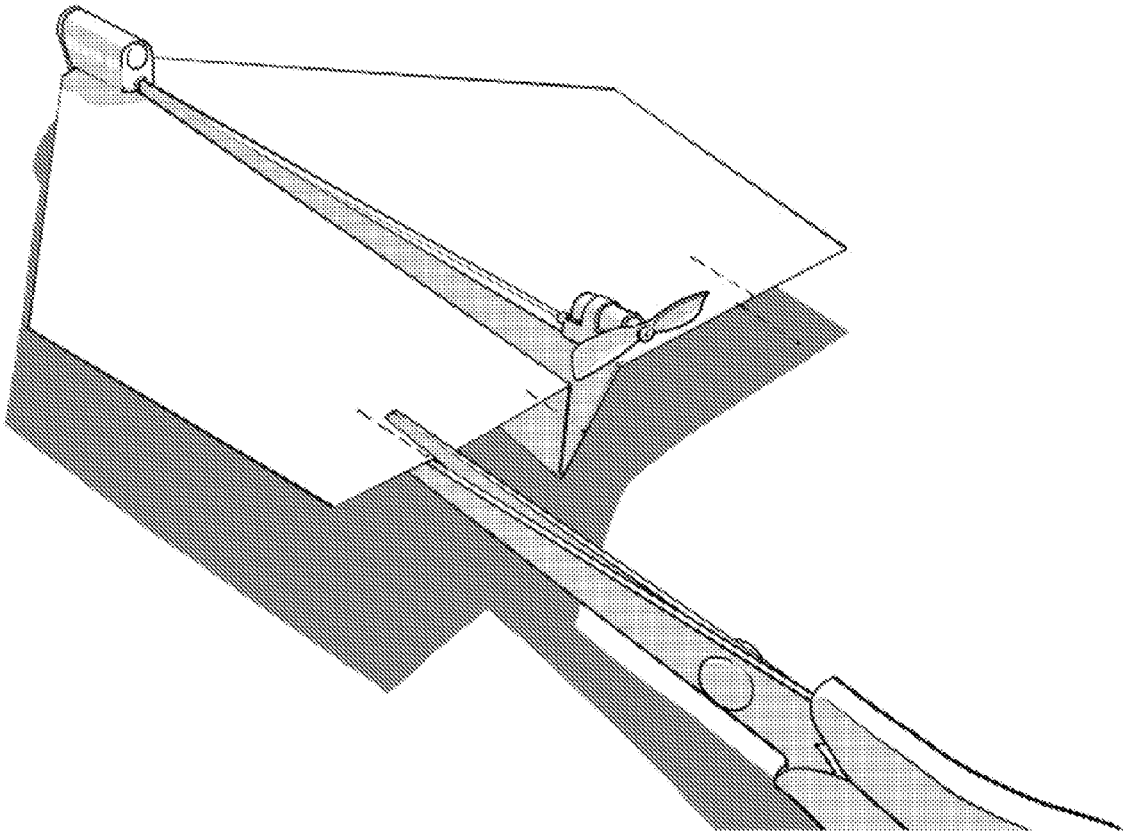
FIG. 14 is a perspective view of the rear of the powered airplane showing the formation of elevators by severing.

The power unit is balanced/weighted to be slightly nose-heavy so that, when installed on the common, neutrally balanced paper airplane, the center of gravity of the assembly is shifted slightly towards the front/nose, intentionally providing additional stability during flight. Control of the direction of flight is achieved by forming elevators and a rudder by severing and bending the trailing edges of the paper stock prior to launch, as indicated in FIG. 14.

The nose of the conversion kit/power unit protrudes beyond the paper airplane front to provide extra protection in case of crash.

The weight of the conversion kit in the center of the airplane will tend to raise the dihedral angle (wings) thus reducing lift properties. The crease spreading action of the fin will tend to reduce the dihedral angle, forcing the wing tip downward (FIG. 10*c*), this assists in compensating for the weight of the conversion kit.

This special clip design can be incorporated in a conversion kit that has radio control capability controlling the thrust and pitch by increasing propeller speed and yaw by a rear controllable rudder.

The invention claimed is:

1. A toy airplane comprising a sheet paper fuselage and wings extending horizontally from respective opposite longitudinal free edges of a vertical crease forming the fuselage and an electric power conversion unit operably mounted thereon, the electric power conversion unit comprising:

a one-piece, plastic nose-piece comprising a combination rechargable electric power supply unit mounting portion and nose clip;

a rechargeable electric power supply unit mounted in the rechargeable electric power supply unit mounting portion;

a rear propulsion unit including an electric motor mount and motor driving a pusher propellor and, an electrical lead connecting the rechargable electric power supply unit to the electric motor and contained in a conduit extending rearwardly above the vertical crease to a tail; wherein:

the conduit is of square cross-section and keys into a complementary socket of the motor mount maintaining the rear propulsion unit tilted upward at a predetermined angle relative to the nose-piece as required for flight stability;

the nose-clip comprises a pair of cantilever leaf spring arms extending rearwardly in spaced-apart, coplanar, side-by-side relation under the rechargeable electric power supply unit mounting portion and having portions which converge horizontally towards each other adjacent rear free ends and, a paper spreading fin depends from a rear end of the nose-piece vertically aligned with and below the conduit and adjacent but spaced apart rearward of free ends of the pair of cantilever leaf spring arms, the paper spreading fin extends from the nose piece more downwardly than rearwardly and is stuffed into the vertical paper crease, maintaining paper walls of the vertical paper crease spread apart, forming the fuselage between the pair of cantilever leaf spring arms so that portions of the pair of the cantilever leaf spring arms which converge horizontally towards each other are in horizontal, inward clamping engagement with the vertical walls of the vertical crease, which are urged horizontally apart by the spreading action of the paper spreading fin and, with leading edge portions of the horizontal paper wings on each side of the vertical paper crease clamped vertically between respective cantilever leaf spring arms of the pair of the cantilever leaf spring arms and the rechargeable electric power supply unit mounting portion.

2. A toy airplane according to claim 1 wherein the nose-piece comprises a rectangular frame portion extending horizontally over the pair of cantilever leaf spring arms providing a counter abutment against which the leading edge portions of the horizontal paper wings are pressed by a clamping action of the pair of cantilever leaf spring arms.

3. A toy airplane electric power conversion unit for a toy airplane comprising a sheet paper fuselage and wings extending horizontally from respective opposite longitudinal free edges of a vertical, fuselage forming crease comprising:

a one-piece, plastic nose-piece comprising a combination rechargable electric power supply unit mounting portion and nose clip;

a rechargeable electric power supply unit mounted in the rechargeable electric power supply unit mounting portion;

a rear propulsion unit including an electric motor mount and motor driving a pusher propellor and, an electrical lead connecting the rechargable electric power supply unit to the electric motor and contained in a conduit for extending rearwardly above the vertical fuselage forming crease to a tail; wherein:

the conduit is of square cross-section and keys into a complementary socket of the motor mount maintaining the rear propulsion unit tilted upward at a predetermined angle relative to the nose-piece as required for flight stability; and, the nose-clip comprises a pair of cantilever spring arms extending rearwardly in spaced-apart, coplanar, side-by-side relation under the rechargeable electric power supply unit mounting portion with which they cooperate to provide a clamping action in a vertical direction, and having portions which converge horizontally towards each other adjacent rear free ends and, a paper spreading fin depends from a rear end of the nose-piece vertically aligned with and below the conduit and, adjacent but spaced apart rearward of free ends of the pair of cantilever spring arms, the fin extending from the nose-piece more downwardly than rearwardly.

4. A toy airplane electric conversion unit according to claim 3 wherein the nose-piece comprises a rectangular frame portion extending horizontally over the pair of cantilever leaf spring arms providing a counter abutment to the pair of cantilever leaf spring arms during paper clamping.

5. A toy airplane electric power conversion unit for a toy airplane comprising a sheet paper fuselage and wings extending horizontally from respective opposite longitudinal free edges of a vertical, fuselage forming crease for a sheet paper airplane comprising:

a one-piece, plastic nose-piece comprising a combination power supply mounting portion and nose clip;

an electric power supply mounted in the power supply mounting portion;

a rear propulsion unit including an electric motor mount and a motor, driving a pusher propeller and, electrical lead means connecting the electric power supply to the electric motor and including a conduit for extending rearwardly above the crease to a tail; wherein:

the conduit is of non-circular cross-section and keys into a complementary socket of the motor mount maintaining the rear propulsion unit tilted upward at a predetermined angle relative to the nose-piece as required for flight stability; and, the nose-clip also comprises a pair of cantilever spring arms extending rearwardly in spaced-apart, coplanar, side-by-side relation under the power supply mounting portion with which they cooperate to provide a paper clamping action in a vertical direction and having portions which converge horizontally towards each other adjacent rear free ends to provide a paper clamping action in a horizontal direction and, a rear, depending paper spreading fin, adjacent but spaced apart rearward of rear free ends of the pair of cantilever spring arms, vertically aligned with and below the conduit, the fin extending from the nose piece more downwardly than rearwardly.

6. A toy airplane electric power conversion unit according to claim 5 wherein the fuselage forming crease has downwardly converging sidewalls forming a V-section profile and the paper spreading fin tapers in width as it extends downwardly providing a matching profile for fitting in the paper spreading fuselage forming crease.

* * * * *